US005152238A

United States Patent [19]

Page

[11] Patent Number: 5,152,238

[45] Date of Patent: Oct. 6, 1992

[54] SPLIT-HINGED, WINGED, SELF-CRADLING SHALLOW DRAFT KEEL FOR SAILING VESSEL

[76] Inventor: Robert L. Page, 5020 Anderson, Manhattan, Kans. 66502

[21] Appl. No.: 750,824

[22] Filed: Aug. 27, 1991

[51] Int. Cl.[5] ..... B63B 41/00

[52] U.S. Cl. ..... 114/143

[58] Field of Search ..... 114/39.1, 39.2, 122, 114/126, 127, 132, 135, 137, 140, 143, 274-276, 284, 285

[56] References Cited

U.S. PATENT DOCUMENTS

| | | | |
|---|---|---|---|
| 369,175 | 8/1887 | Gaughen . | |
| 537,667 | 4/1895 | Beardsley et al. . | |
| 618,911 | 2/1899 | Shewring . | |
| 685,648 | 10/1901 | Schoenhut . | |
| 699,231 | 5/1902 | Pool . | |
| 700,011 | 5/1902 | Becker . | |
| 704,685 | 7/1902 | Jensen . | |
| 731,227 | 6/1903 | Royse . | |
| 1,475,460 | 11/1923 | Thompson et al. . | |
| 2,363,421 | 11/1944 | Huard . | |
| 2,448,075 | 8/1948 | Bortner . | |
| 2,513,585 | 7/1950 | Powers | 114/143 |
| 2,553,372 | 5/1951 | Hurst | 114/143 |
| 4,044,703 | 8/1977 | Kurtz | 114/143 |
| 4,117,795 | 10/1978 | Ruiz | 114/68 |
| 4,352,335 | 10/1982 | Sugden | 114/143 |
| 4,377,124 | 3/1983 | Guigan | 114/128 |
| 4,453,484 | 6/1984 | Englund | 114/143 |
| 5,009,178 | 4/1991 | Geffken | 114/137 |

*Primary Examiner*—Jesus D. Sotelo

*Attorney, Agent, or Firm*—Hovey, Williams, Timmons & Collins

[57] ABSTRACT

A sailing vessel is disclosed having a segmented winged keel made up of a pair of L-shaped keel members which are independently swingable toward and away from one another. When in their normal, side by side, closed positions, the keel members define an inverted-T. Each keel member is swingable through an arc of approximately 90° to decrease the overall draft of the vessel, or alternately to thwart a tendency for the vessel to heel in a crosswind. Mechanism is connected to the keel members to permit selective independent swinging thereof from the cabin or cockpit of the vessel. The rudder of the vessel may similarly be raised to a level such that it also does not extend below the normal longitudinally extending main keel of the vessel.

12 Claims, 3 Drawing Sheets

SPLIT-HINGED, WINGED, SELF-CRADLING SHALLOW DRAFT KEEL FOR SAILING VESSEL

BACKGROUND OF THE INVENTION

1. Field of the Invention

This invention relates to marine craft and particularly sailing vessels having keel structure for enhancing not only the stability of the boat under varying wind conditions but also to control the extent of heel-over in strong cross winds.

In its preferred embodiment, the keel structure is of the winged type and is divided into two separate mirror image sections that are pivotally supported beneath the vessel's hull for independent swinging movement transversely of the boat.

2. Description of the Prior Art

Sailboats have long been provided with relatively large, heavy keels which depend from the central lower section of the hull and provide ballast against heeling. The types of keels which have been employed vary widely. Many sailboats have keels that can be raised in some manner to decrease the draft of the vessel in shallow water conditions. Smaller boats, for example, have been provided with vertically moveable dagger boards. Boats of intermediate size often are provided with swingable center boards that can be raised by pulling upwardly on one end of the keel member. Larger sailing boats generally have fixed keels because it is usually impractical to raise a mass weighing many hundreds to several thousand pounds. Keels which extend below the bottom of the hull several feet, however, severely limit shallow water operation of the boat.

Efforts have been made to increase the effectiveness of keel structure without adversely effecting the overall speed and maneuverability of the boat, but have not met with great success, primarily because of cost considerations. In recent years, the functionality of keel structure for sailboats has been increased by adding outwardly projecting "wings" which serve to stabilize the vessel and further minimize heel-over in strong cross winds. In fact, by decreasing the degree of heel-over, a winged keel boat may actually go somewhat faster than its non-winged counterpart under the same cross wind conditions.

Shallow draft operation is still limited even with wing keels, and it is not possible to provide optimum compensation against heel over for different wind conditions. Various suggestions for mounting a keel member on the bottom of the boat hull so that it will move laterally have not found widespread usage because of the difficulty of swinging a relatively heavy weight, and the complexity of the mechanism required to move a heavy keel through small increments and within a useful time span.

Many prior laterally movably keel designs have employed a simple fin element which is swingable about a fore and aft axis adjacent the keel board of the boat. Exemplary in this respect, is the pivoted center fin of the boat as illustrated in U.S. Pat. No. 2,553,372. A somewhat more complicated pivotal fin which is also said to serve as a hydrofoil is shown and described in U.S. Pat. No. 3,324,815.

Efforts have even been made to solve the heel-over problem by swinging the mast laterally along with the keel structure to maintain the keel and mast in general symmetrical relationship. Exemplary in this respect are U.S. Pat. Nos. 3,903,827, 3,972,300, 4,094,263 and 4,117,797. However, moving the mast as well as the keel adds to the complexity of the operating mechanism and increases the initial cost of the boat as well as maintenance expenses required to keep the components fully operational.

SUMMARY OF THE INVENTION

The sailing vessel of the present invention preferably has a pair of L-shaped keel members which cooperate to define inverted-T keel structure. The keel members are separately mounted on the bottom of the hull for independent movement laterally of the boat. Each of the L-shaped keel members may be pivoted through an arc of at least about 90° so that the members may be shifted as desired to stowed positions against the bottom of the hull for minimum draft operation of the boat in shallow waters, or for storage of the vessel in an upright position resting on the folded keel members.

Power operated mechanism is connected to the L-shaped keel members so that each may be selectively raised or lowered from a remote control point, as for example, the cabin or cockpit of the boat. The keel operating mechanism is constructed so that the components may be easily disassembled for repair of bearings, maintenance of the parts, or for part replacement purposes.

BRIEF DESCRIPTION OF THE DRAWINGS

FIG. 13 is a schematic representation similar to FIG. 10, but illustrating operation of the vessel under somewhat higher wind conditions.

DETAILED DESCRIPTION OF THE PREFERRED EMBODIMENT OF THE INVENTION

Figure 2:
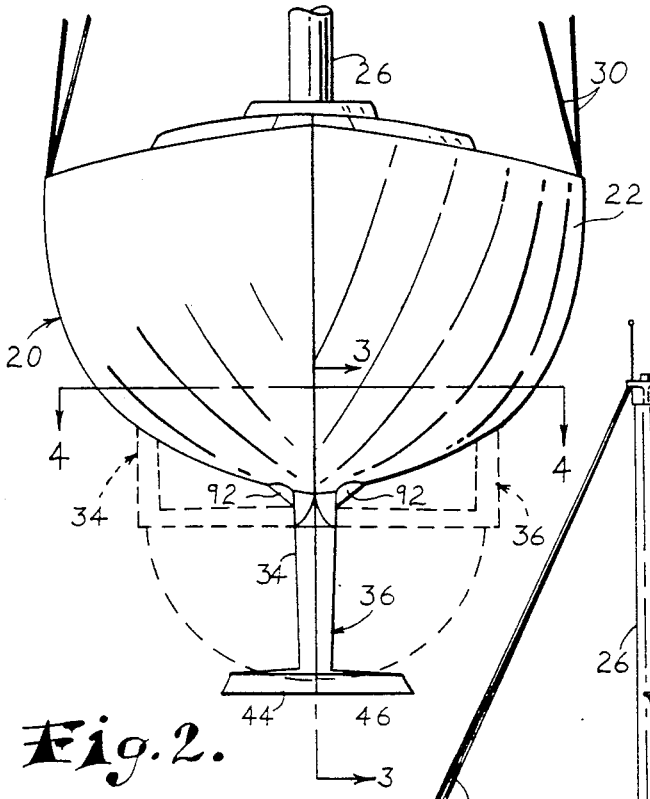
FIG. 2 is a fragmentary, enlarged, front elevational view of a sailing vessel as shown in FIG. 2 and illustrating by dash lines the path travel of each L-shaped keel members making up the inverted-T keel structure.

The sailing vessel broadly designated 20 may be of steel, aluminum or other material such as a glass fiber reinforced resin having a single hull 22 that is provided with a keel 24 extending fore and aft of the hull bottom. Upright mast 26 carried by hull 22 mounts a pivotal boom 28 thereon pivotally secured to the mast 26 in closer proximity to hull 22 than the upper extremity of mast 26. A series of lines 30 stabilize the mast 26 and hold the latter in an upright position. The typical water line for hull 22 is indicated by the appropriately designated horizontal long dash line in FIG. 1. For example, if the boat is 45 feet in length, the water line would be generally 36 feet in length with the indicated overhangs.

Inverted-T keel structure 32 comprising the invention hereof is mounted on the underside of hull 22 substantially midway of the keel 24 in depending relationship therefrom. Structure 32 includes a pair of L-shaped keel members 34 and 36 which are pivotally mounted for swinging movement through maximum arcs of approximately 90° from the extended full line positions illustrated in FIG. 2 to respective folded dotted line positions thereof as depicted in that Figure.

Figure 1:
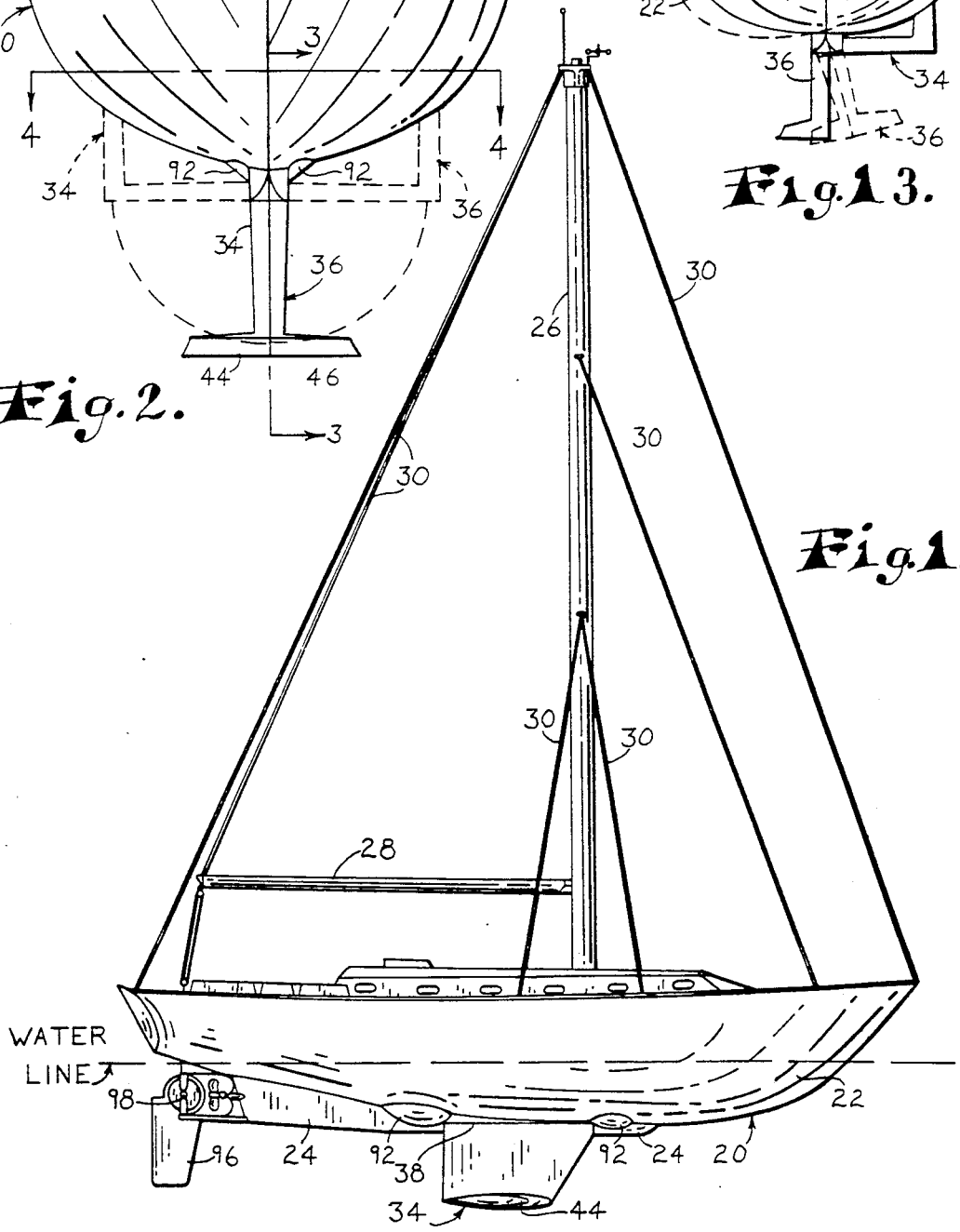
FIG. 1 is a side elevational view of a sailing vessel having inverted-T keel structure mounted on the bottom of the hull made up of two separate, independently moveable L-shaped keel members.

As is apparent from FIGS. 1–5 and 7, hull 22 is provided with an elongated, relatively narrow recess 38 in the keel 24 and lowermost portion of the hull for receiving the upper margins of the planar base leg portions 40 and 42 of respective L-shaped keel members 34 and 36. From FIGS. 1, 3 and 4, it can been seen that L-shaped members 34 and 36 have generally planer wing portions 44 and 46 respectively which are affixed to project outwardly in opposite directions from a corresponding base leg portion 40 or 42. As is also illustrated in the schematic representations of FIGS. 7 and 8, base leg portions 40 and 42 have relatively flat inner surfaces **40*a* and 42*a* respectively, while the outer major surfaces 40*b* and 42*b* are curvilinear fore and aft of the keel structure 32 so that the two keel members 34 and 36 when in their extended positions as depicted in FIG. 1, present a streamlined configuration for minimum resistance to water flow therepast. The base leg portions 40 and 42, as well as each of the wing portions 44 and 46 increase in thickness from the leading edges thereof until a point is reached about 40% of the overall length of a corresponding base leg portion or the respective wing portion. Thereafter, the base leg portions 40 and 42 as well as wing portions 44 and 46 decrease in thickness until a point is reached which is spaced from the trailing margins of corresponding base leg portions 40 and 42 or a wing portion 44 or 46**, a distance equal to about 40% of the overall length of the base portion or wing portion. The last 40% of the fore and aft extent of each base leg portion or wing portion is essentially a straight tapered configuration.

The same relationships apply with respect to the configuration of the wing portions 44 and 46, i.e. they are of greatest thickness at a point 40% of the distance from the leading edge of respective members and then become straight tapers throughout the last 40% of their fore and aft dimensions. It therefore can be seen that the outer surfaces of the base leg portions 40 and 42 and wing portions 44 and 46 are of generally curvilinear shape which merges with and joins the rearmost straight tapered portions of the leg portions and wing portions.

Figure 3:
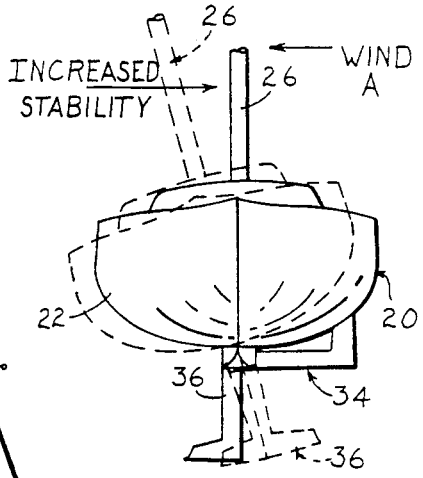
FIG. 3 is an enlarged, fragmentary, partially schematic, side elevational view of the keel structure mounted at the lower part of the boat hull, along with operating mechanism for swinging the L-shaped keel members about respective longitudinal axes, with parts being broken away for clarity.

Spaced, parallel, upright watertight bulkheads 48 and 50 which extend transversely of hull 22 and define the front and rear faces of recess 38 are also joined to the bottom hull wall 52, as best shown in FIG. 3. Two additional fore and aft watertight bulkheads 54 and 56 are parallel with cross bulkheads 48 and 50 and are in turn inboard of an additional pair of fore and aft cross bulkheads 58 and 60 which likewise are parallel with hull cross bulkheads 54 and 56. Horizontally oriented compartment tops 59 are provided across the internal space within hull 22 between opposed interior surfaces of the hull walls, and cooperate with the bulkheads, the bottom wall and the keel sections to form respective watertight compartments. Each of the tops 59 has an access plate 61 removably secured to a corresponding wall 59 in closing relationship to apertures 63 so that the interior of the watertight compartments may be accessed.

Elongated, parallel, main shafts 62 and 64 substantially equal in length to the fore and aft distance between the opposed, inner faces of cross bulkheads 48 and are mounted between cross bulkheads 48 and 50 for rotation about respective axes thereof. Stub shaft assemblies 66 and 67 are splined to opposite ends of main shaft 62 while stub shaft assemblies 68 and 69 are splined to opposite extremities of main shaft 64.

Figures 5, 6, 9, 10, 11, 12:
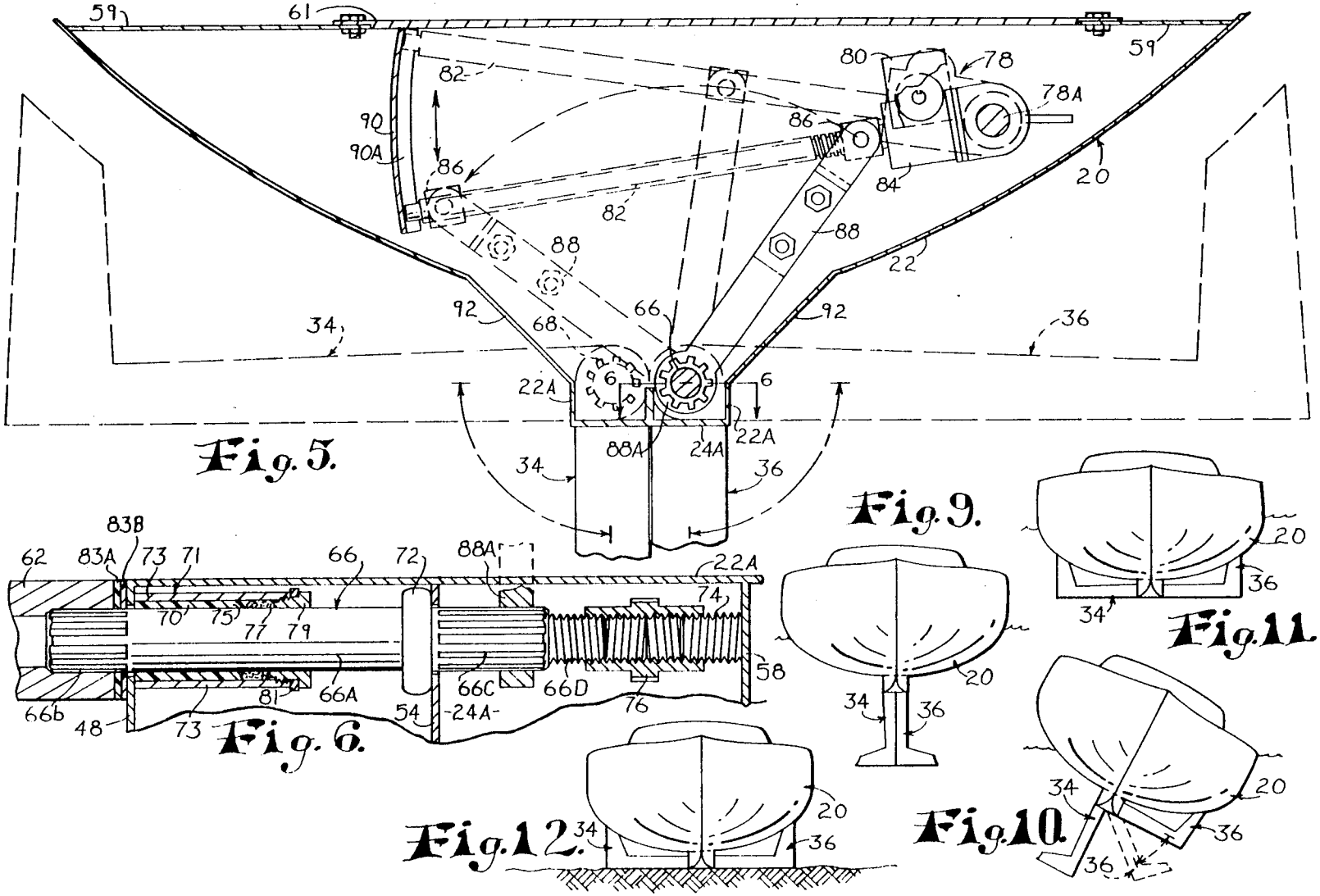
FIG. 5 is an enlarged, fragmentary, vertical cross sectional view taken substantially on the line 5—5 of FIG. 4 and looking in the direction of the arrows.
FIG. 6 is an enlarged, fragmentary, vertical cross-sectional view taken substantially on the line 6—6 of FIG. 5 and looking in the direction of the arrows.
FIG. 9 is a generally schematic front elevational representation of the sailing vessel and showing the L-shaped member in the keel structure in their fully extended, normal positions extending downwardly from the vessel hull.
FIG. 10 is also a generally schematic view similar to FIG. 9 but showing one of the L-shaped keel members in its fully retracted position by full line depiction, and an alternate intermediate position of such keel member by dash lines to counteract the heeling force of the wind.
FIG. 11 is a generally schematic front elevational view of a vessel illustrating the L-shaped keel members in their fully extended positions against the underside of the hull.
FIG. 12 is also a generally schematic representation like FIG. 11 except that the L-shaped keel members are illustrated in their retracted positions and the boat thereby resting on the bottom of the body of water.

The nature and construction of the stub shaft assemblies 66, 67, 68 and 69 is best understood from FIG. 6 which is taken along the line 6—6 of FIG. 5. As is apparent from FIG. 6, the stub shaft assembly 66 has a cylindrical shaft segment **66*a* provided with a spline section 66*b* on one end thereof complementally received within the longitudinally grooved adjacent end of main shaft 62. The central smooth portion of shaft segment 66*a* is rotatably carried by a ball bearing unit 72 affixed to the face of bulkhead 54 in direct opposition to bulkhead 58. The end of shaft segment 66*a* opposed to spline section 66*b* extends through the bulkhead 54 and has an externally splined intermediate section 66*c*. The terminal end 66*d* of the shaft segment 66*a* is externally threaded and receives one end of an internally threaded coupler 76 that has internal spiral grooves that are oppositely threaded to receive the threaded end 66*d* as well as the oppositely threaded member 74 in axial alignment with the segment 66*d***.

Again viewing FIG. 6 it is to be seen that an annular sealing unit 71 is provided on the shaft assembly 66 between bulkheads 48 and 54 to prevent water from entering the watertight compartment. To this end, a cylindrical housing 73 is affixed to the innermost face of bulkhead 48 in axial alignment with the shaft segment **66*a*. A nitrile rubber bearing sealing member 75 is located within housing 73 in sealing engagement with the external surface of shaft segment 66*a***. An annular packing member 77 surrounds the shaft segment 66*a* outboard of sealing member 75 while an annular compression nut 79 threaded into the outermost end of the housing 73 permits adjustable pressure to be applied to the packing member 77 and associated sealing member 75. A lock nut 81 is desirably located between the flange portion of compression nut 79 and the outer, internally threaded end of housing 73. It can therefore be seen that tightening of the compression nut 79 compresses the annular packing member 77 to assure watertight integrity of the shaft segment 66*a*.

A pair of annular friction bearings 83*a* and 83*b* are located in surrounding relationship to the splined end 66*b* of shaft segment 66*a* outboard of the bulkhead 48, thus permitting free rotation of the shaft 62 with respect to bulkhead 48.

Figures 3, 4, 7, 8:
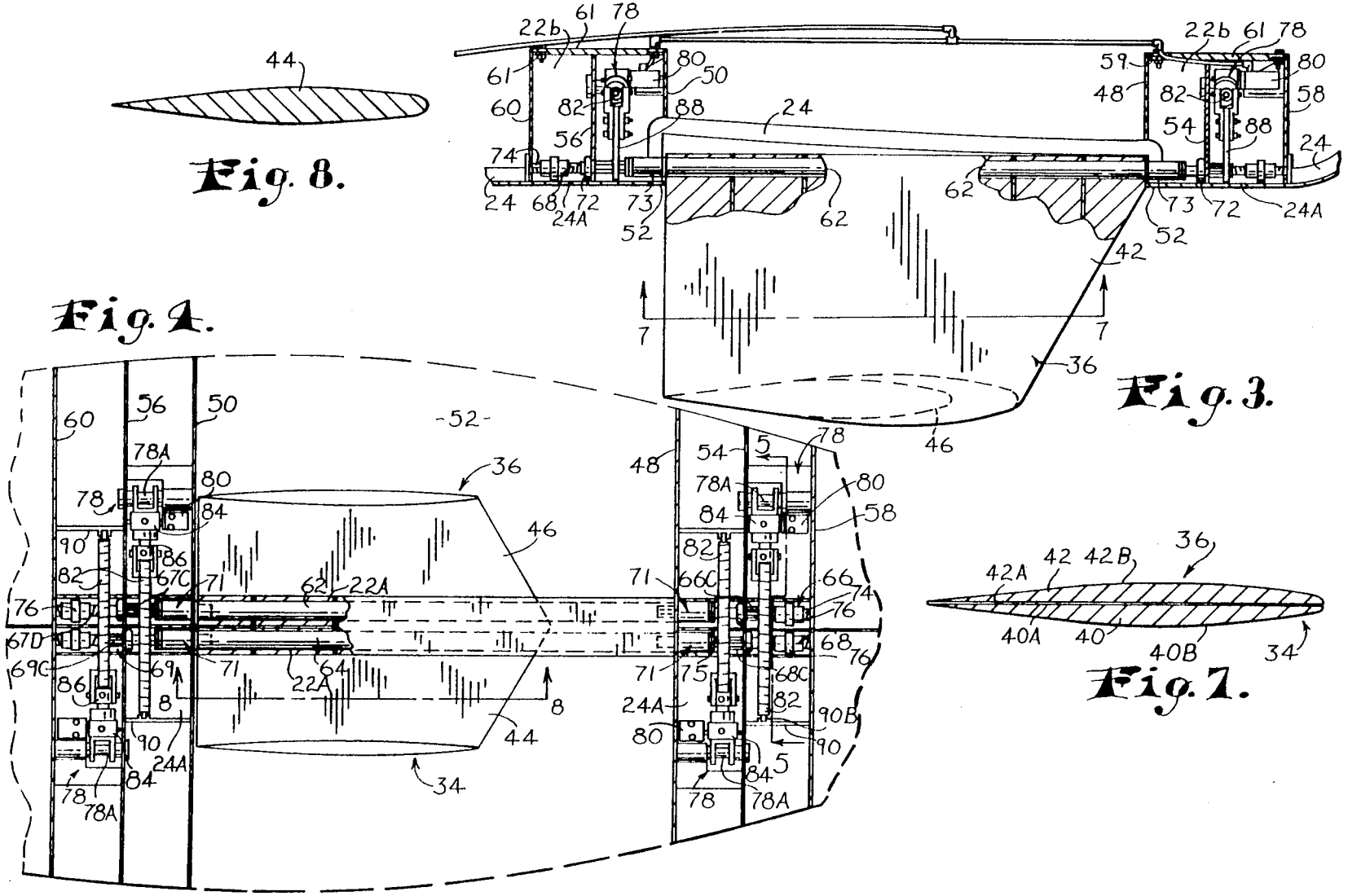
FIG. 4 is an enlarged, fragmentary, partially schematic, top view of the keel structure and operating mechanism therefore as illustrated in FIG. 3, with parts again being broken away for clarity.
FIG. 7 is a horizontal, essentially schematic cross-sectional view taken along the line 7—7 of FIG. 3.
FIG. 8 is a horizontal, essentially schematic cross-sectional view taken along the line 8—8 of FIG. 4.

As is apparent from FIGS. 3 and 4, the shaft assembly 67 connected to main shaft 62 at the end thereof opposed to shaft assembly 66, is also splined to main shaft 62 but has a splined section 67*c* between the bulkheads 50 and 56, instead of outboard of the middle bulkhead as is the case with the splined section 66*c*. In like manner, the ball bearing unit 72 forming a part of the stub shaft assembly 67 is located on the face of bulkhead 56 in direct opposition to bulkhead 60. As is further apparent from FIGS. 3 and 4, the stub shaft assembly 67 has a coupler 76 which connects the threaded extremity 67*d* with the associated threaded member 74.

The details of construction of stub shaft assemblies 68 and 69 need not be described in detail in view of the fact that the assembly 68 is similar to assembly 67 and assembly 69 is similar to assembly 66 with the orientation of the individual components thereof being essentially the same.

The provision of the four couplers 76 allows selective removal of the stub shafts 66–69 for maintenance and part replacement purposes by rotation of the couplers 76 in a suitable direction to either separate the threaded ends of the stub shafts from axially aligned threaded members 74, or to reconnect the stub shaft assembly when the repair or maintenance procedures have been completed.

It can also be seen from FIGS. 5 and 6 that the keel 24 of hull 22 has a segment 24*a* which extends downwardly from the main keel 24 of the boat for accommodating stub shafts 66 and 68, and that upright, fore and aft oriented, transversely spaced outer hull wall sections 22*a* and 22*b* join with respective outwardly inclined hull segments 92 that merge with the main curved lower hull portions of the hull 22.

The mechanism 78 for selectively rotating the main shafts 62 and 64 is best illustrated in FIGS. 3–6, wherein it can be seen that two prime movers, each of which may be a machine screw mechanical actuator operated by a hydraulic or electrical motor. Linkage connected to the actuator is employed to rotate each of the shafts 62 or 64, and thereby the keel members 34 or 36. The force employed to effect lifting of the split keel members is transmitted to the bulkhead frames 54 and 58 by a pin 78*a* about which the actuator pivots to a predetermined extent. It is to be appreciated that the mechanisms 78 at opposite ends of the main shafts 62 or 64, are adapted to be operated in tandem. As a consequence, tie-in control means is provided for causing both motors 80 at opposite ends of a particular main shaft 62 or 64 to operate simultaneously when the control means is actuated to raise or lower either one of the keel members 34 or 36, or both of such keel members. In view of the fact that the mechanisms 78 for effecting selective rotation of shafts 62 and 64, and located at opposite ends thereof in engagement with respective stub shafts 66 and 68 are essentially the same, only one of the power operated mechanisms 78 need be described in specific detail.

For example, as depicted in FIG. 5, each keel member operating mechanism 78 includes a hydraulically actuated motor 80 which rotates an elongated threaded rod 82 through a suitable gear reduction unit 84. The rod 82 carries a threaded nut 86 thereon which supports a clevis forming a part of an elongated connector arm 88. The lowermost end of each arm 88 has an enlarged section 88*a* provided with an internal grooved opening for mating relationship with the splined sections 66*c*, 67*c*, 68*c* and 69*c* respectively of the corresponding stub shaft 66 (see FIGS. 5 and 6). A longitudinally extending wall 90 between bulkheads 54 and 58, or between bulkheads 56 and 60, as the case may be, is arcuate as shown in FIG. 5, and has inwardly extending transversely oriented extensions 90*a* and 90*b* which define a track that receives the outer terminal end of a corresponding connector rod 82.

The portion of the keel 24 adjacent the rearward edges of keel members 34 and 36 is configured to receive the keel member operating mechanism as shown in FIGS. 3 and 4. As is most apparent from FIG. 1, hull 22 may have a pair of streamlined fairings or the like 92 on opposite sides of the keel 24 ahead of the keel members 34 and 36, as well as a pair of somewhat larger streamlined fairings 94 aft of the keel members 34 and 36 to accommodate components of keel member operating mechanisms 78.

It is also to be understood that the rudder 96 pivots between two cheeks about axis 98 so that the rudder 96 may be raised into a position such that the lower edge thereof is essentially aligned with the bottom of the keel 24. The rudder 96 is also rotatable about a vertical axis for steering of the vessel. Suitable mechanism is provided (not shown) permitting raising and lowering of rudder 96, either manually through use of a windlass, or electrically or hydraulically power operated means.

Means for locking the keel members 34 and 36 in their raised positions may be accomplished through use of a cam on a shaft passing through a watertight seal in the hull and functional to lock the end of a respective keel member to the hull (not shown).

Operation

In the normal operation of sailing vessel 20, keel members 34 and 36 are maintained in the extended positions thereof as illustrated in FIGS. 1–3, and 9. Furthermore, the rudder 96 is deployed in the disposition shown in FIG. 1. In the extended positions of keel members 34 and 36 wherein the base leg portions 40 and 42 are in side-by-side engaging relationship, the T-keel structure 32 functions in the usual manner thereof where the wing portions 44 and 46 enhance stability of the boat by concentrating ballast at the lowest portion of the keel.

Various selected positions which keel members 34 and 36 may be placed are shown in the representative schematic illustrations of FIGS. 9–13 inclusive.

As shown in FIG. 13, in higher wind conditions, and especially winds directly abeam of the boat (Arrow A), the stability of the vessel can be significantly enhanced (Arrow B) by raising the keel member 36 which is to the windward of the boat. In that manner, the center of gravity is shifted and the righting moment of the vessel is altered, decreasing the tendency of the boat to heel and thereby preventing deterioration of the boat speed as it leans over, thus spilling wind from the sails.

In order to effect selective raising of the windward keel member, the associated motors 80 at opposite ends of a respective main shaft 62 or 64 are simultaneously operated to turn corresponding threaded rods 82 and cause nuts 86 to shift along the length of a rod 82. This in turn rotates a respective connector arm 88, thus imparting rotational movement to the associated main shaft 62 or 64 through corresponding stub shaft assemblies connected thereto. Actuation of the selected prime movers 80 may be controlled from the cockpit or cabin of the vessel 20 with the understanding that appropriate indexes may be provided at the control location so that the helmsman or other crew member can determine from the control panel how many degrees a respective keel member 34 or 36 has been raised from its normal extended position, as shown in FIG. 2, toward the fully retracted position shown by dash lines in that figure.

When it is desired to operate vessel 20 in shallow waters that would cause the T-keel structure to perhaps drag on the bottom, both of the keel members 34 and 36 may be raised as required to prevent dragging of the T-keel structure. The operator or crew of vessel 20 can raise the keel members 34 and 36 to the full retracted positions as shown in FIG. 2 by actuating respective pairs of the keel member operating mechanisms 78, either simultaneously or in sequence.

When the keel members 34 and 36 are rotated through an arc about 90°, thus bringing the base leg portions 40 and 42 thereof into essentially horizontal positions, the outer extremities of the wing portions 44 will normally be located either closely adjacent to or in engagement with the proximal surface of the hull 22. In that manner, the draft of the vessel 20 is no deeper than the keel 24 of the boat. Raising of the keel members 34 and 36 permits use of the vessel 20 in shallow areas that would otherwise be inaccessible.

If it is desired to use the keel members 34 and 36 as a cradle for storing the vessel on land, or to maintain the boat in an upright position when the tide goes out to an extent to expose the bottom of the boat if the keel members were left in their usual extended locations, that result may be accomplished by raising the keel members 34 and 36 to their fully retracted positions as schematically illustrated in FIG. 12. In like manner, the keel members 34 and 36 may be retracted to the positions as shown in FIG. 12 for extended storage of the vessel on dry land, or during shipping of the vessel as cargo. Retraction of the keel members 34 and 36 reduces the height of the vessel during shipping as well as storage. Support of the boat on retracted keel members 34 and 36 facilitates uniform drying out of the boat under tide out conditions, where the boat rests on the bottom or is very near thereto.

Although not depicted in the drawings, it is to be recognized that wheels or rollers may be provided on the downwardly facing surfaces of the keel members 34 and 36 when retracted for facilitating self-launching of vessel 20 utilizing a railway system or the ramp surface.

The seals on the shafts which are rotated by the operating mechanisms 78 prevent leakage of water under varying conditions. However, if for any reason a seal should start to leak, the leak will be contained by the water-tight compartments. If there is a need to replace one of the shafts or the operating mechanisms therefor, this may be readily accomplished by rotating couplers 76 to free the ends of the stub shafts 66–69 so that repairs may be made quickly and efficiently, or parts replaced as may be necessary.

I claim:

1. In a sailing vessel having a hull, an improved keel assembly for the hull comprising:

a pair of keel members each having a generally planar base leg portion;

means for pivotally securing the base leg portions of the keel members to the underside of the hull in side by side disposition extending fore and aft of the hull, each of the keel members being swingable in directions toward and away from the other keel member to selectively permit decrease in the overall draft of the vessel and to provide compensation for a tendency of the vessel to heel in a cross wind;

mechanical means housed within the hull and including prime mover means for positively raising and lowering each of the keel members independently of one another to a selectable extent; and said mechanical means including components connected to said prime mover means for fixedly holding each of the keel members against further swinging movement when located in a selected position relative to the other keel member.

2. A sailing vessel as set forth in claim 1 wherein each of said keel members has a generally planar wing portion projecting away from a respective planar base portion, each of said keel members being swingable toward and away from closed positions where the base leg portions are in adjacent, side by side relationship, and the outwardly projecting wing portions cooperate with the base leg portions to define an inverted-T keel assembly.

3. A sailing vessel as set forth in claim 2 wherein each of said wing portions is at essentially a right angle with respect to a corresponding supporting base leg portion.

4. A sailing vessel as set forth in claim 3 wherein each of the keel members is swingable through an arc of at least about 90°.

5. A sailing vessel as set forth in claim 1 wherein said means for securing the keel members to the underside of the hull includes pivot structure for each keel member, each of said pivot structures being located in disposition extending fore and aft of the hull, the pivot structures for said keel members being in generally parallel relationship one to the other, and means for joining respective pivot structures to the base leg portion of a corresponding keel member, said prime mover means being operable to rotate the pivot structures relatively to positively and independently swing the keel members toward and away from one another.

6. A sailing vessel as set forth in claim 5 wherein said components of the mechanical means for positively and independently rotating respective pivot structures include a lever arm connected to a corresponding pivot structure, and means for independently effecting swinging corresponding lever arms.

7. A sailing vessel as set forth in claim 6 wherein said prime mover means for positively and independently swinging a respective lever arm includes an elongated rotatable screw, a follower connected to the lever arm and embracing the screw for movement there along in response to the rotation of the screw, and selectively operable motor means for rotating the screw.

8. A sailing vessel as set forth in claim 1 wherein the height of each base leg portion of the keel assembly is correlated with the width of a respective wing portion secured thereto so that when the keel members are moved from their closed positions projecting downwardly from the underside of the hull and defining a T-shaped transversely of the hull, to their retractive open positions, the base leg portions lie in an essential common plane transversely of the hull, with the outer most extremities of the wing portions in proximal relationship to the underside of the hull.

9. A sailing vessel as set forth in claim 1 wherein the base leg portion of each keel member is of a length fore and aft of the hull that is greater than the height dimension of the keel member measured perpendicular to the length dimension thereof, the wing portion of the keel member being of a transverse width in a direction away from the supporting base portion that is less than the length and height dimensions of the leg portion.

10. A sailing vessel as set forth in claim 1 wherein the leg portion and wing portion of each keel member is of streamlined cross sectional configuration fore and aft of the hull to minimize resistance to flow of water thereover and to provide a lift effect when the vessel sails to windward.

11. A method of thwarting the tendency of a sailing vessel hull to heel in a cross wind comprising the steps of:

pivotally attaching a pair of L-shaped keel members to the underside of the hull in disposition such that the keel members cooperate to define an inverted T-shaped keel;

positively and independently swinging the windward L-shaped keel member away from the other keel member when the hull starts to heel in a cross wind;

positively and independently swinging the keel member on the windward side of the hull away and up from the other keel member when the hull starts to heel in such cross wind and mechanically securing each of the keel members against further swinging movement after a selected keel member has been swung away from the other keel member to a predetermined extent to counteract cross wind heeling of the hull.

12. A method as set forth in claim 1 wherein is included the step of adjusting the position of the shifted windward keel member until the hull has been righted to a predetermined extent.

* * * * *